US011718437B2

(12) United States Patent
Medina et al.

(10) Patent No.: US 11,718,437 B2
(45) Date of Patent: Aug. 8, 2023

(54) LABEL-REJECTING STATION

(71) Applicant: G.D S.p.A., Bologna (IT)

(72) Inventors: Enrico Medina, Bologna (IT); Francesco Milandri, Bologna (IT); Giuliano Gamberini, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 17/367,789

(22) Filed: Jul. 6, 2021

(65) Prior Publication Data

US 2022/0009665 A1 Jan. 13, 2022

(30) Foreign Application Priority Data

Jul. 7, 2020 (IT) ..... 102020000016363

(51) Int. Cl.
*B65C 9/42* (2006.01)
*B65C 9/08* (2006.01)
*B65C 9/40* (2006.01)

(52) U.S. Cl.
CPC ..... *B65C 9/42* (2013.01); *B65C 9/08* (2013.01); *B65C 2009/404* (2013.01)

(58) Field of Classification Search
CPC ..... B65C 9/08; B65C 9/40; B65C 2009/402; B65C 2009/404; B65C 9/42
See application file for complete search history.

(56) References Cited

U.S. PATENT DOCUMENTS

2005/0274458 A1* 12/2005 Carver ..... G06K 17/00 156/702
2018/0186496 A1* 7/2018 Mevada ..... B65C 9/1865

FOREIGN PATENT DOCUMENTS

EP 1072520 A1 1/2001
WO WO-2011114565 A1 * 9/2011 ..... B65C 9/40
WO 2017055936 A1 4/2017

OTHER PUBLICATIONS

Translation of WO2011114565A1, Iwamatsu H, Sep. 2011 (Year: 2011).*
Italian Search Report dated Mar. 26, 2021. 7 pages.

* cited by examiner

*Primary Examiner* — George R Koch
(74) *Attorney, Agent, or Firm* — RMCK Law Group PLC

(57) ABSTRACT

A label-rejecting station, where labels are carried by a support band along an advancing path. The rejecting station includes a deviator element and a contrast element. The deviator element is arranged along the advancing path and movable between an inactive position and an active position wherein it contacts the support band at a first surface thereof, deviating the advancing path. The contrast element is arranged along the advancing path downstream of the deviator element and includes: an abutting surface provided for receiving partially thereon a second surface of the support band, opposite to the first surface; and a detachment edge provided for detaching a label from the support band when the deviator element moves into its active position.

14 Claims, 3 Drawing Sheets

LABEL-REJECTING STATION

CROSS-REFERENCE TO RELATED APPLICATION

This application claims priority to Italian Patent Application No. 102020000016363 filed Jul. 7, 2020. The disclosure of the above application is incorporated herein by reference in its entirety.

FIELD OF THE INVENTION

The present invention relates to a station for rejecting labels, which can be used in a labelling machine.

Background and description of the prior art Labelling machines, for example in the pharmaceutical sector, are used to apply—on various types of articles, for example, containers such as vials or bottles—relative self-adhesive labels that contain information printed on them (identification code/bar code of the article, contents and/or its expiration date, etc.).

A labelling machine, in general, comprises, in succession: a station for feeding the labels, wherein the labels to be applied to the articles are fed, supported by a band, along an advancing path; a control station and a label-rejection station where, respectively, the compliance of the labels is checked and any non-compliant labels are discarded. Finally, a station for applying the labels is provided, arranged at the end of the advancing path, where the labels are applied to the respective articles.

In the label-control station, as said, the conformity of the labels themselves, and—in particular—of their printing, is checked: it may happen, indeed, that the printed information is faded, partially or completely missing. To this end, the control station comprises a control system generally of the optical type.

In the event that a label is compliant, it proceeds along the advancing path until it reaches the application station, where it is applied to a respective article. If, on the other hand, the control system detects the non-conformity of a label, the label must be discarded to prevent it from being applied incorrectly on an item.

For this purpose, the label-rejecting station comprises a deviator and detachment element, which is arranged along the advancing path, and is activated to deviate the support band of the labels at the label to be rejected. The deviation angle of the band of the labels must be large enough to ensure the detachment of the label from the band itself, or rather, its lifting with respect to the band. Therefore, the deviator and detachment element usually acts along a direction perpendicular to the advancing path of the band, to divert its path.

The rejecting station further comprises a roller for collecting the rejected labels, arranged to intercept a label that is lifted from the support band by the deviator and detachment element, thus attaching itself to the collection roller itself.

However, the known solution described above has a drawback.

In fact, the deviation of the path of the support band, useful for guaranteeing the detachment of the non-compliant label from it, involves a decrease in the tensioning of the support band itself, which is carried to travel a significantly longer path than the path taken in the event of compliant labels. This loss, even partial, of tension often results in a non-optimal and imprecise application of compliant labels to the respective articles, which may lead to the rejection of the articles themselves.

OBJECT AND SUMMARY OF THE INVENTION

The object of the present invention is to overcome the aforementioned drawback.

This object is achieved by proposing a label-rejecting station in accordance with the attached claims.

Advantageously, the label-rejecting station according to the present invention allows rejection of non-compliant labels, while still ensuring optimal application of the compliant labels to the respective articles. In other words, the presented solution guarantees the tensioning of the support band even in the case of rejection of one or more labels.

BRIEF DESCRIPTION OF THE DRAWINGS

Specific embodiments of the invention and further advantages will be made evident in the following description, with the aid of the attached drawings, in which.

DESCRIPTION

Figure 1:
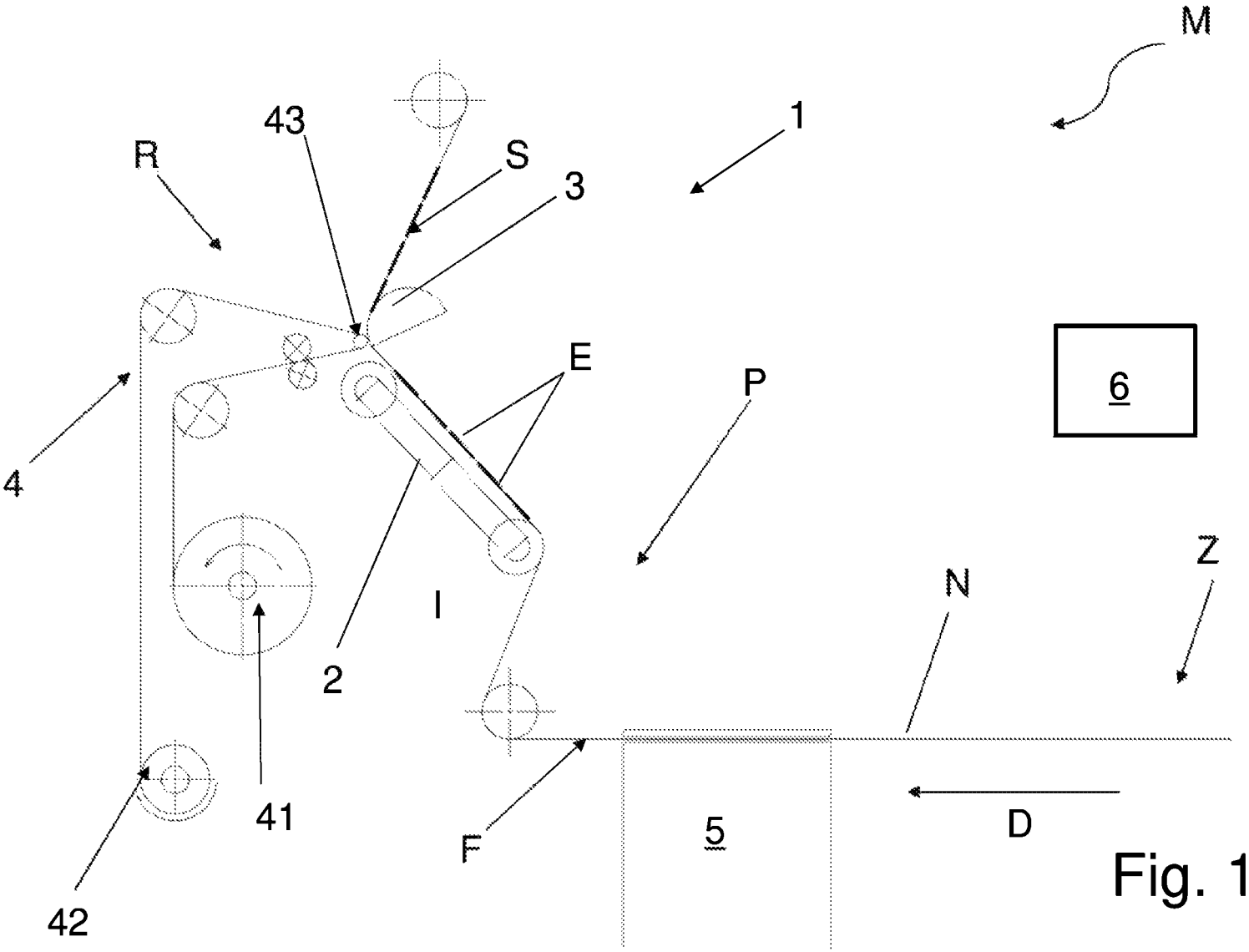
FIG. 1 schematically illustrates a label-rejecting station according to the invention, in a first operating configuration.
Figure 2:
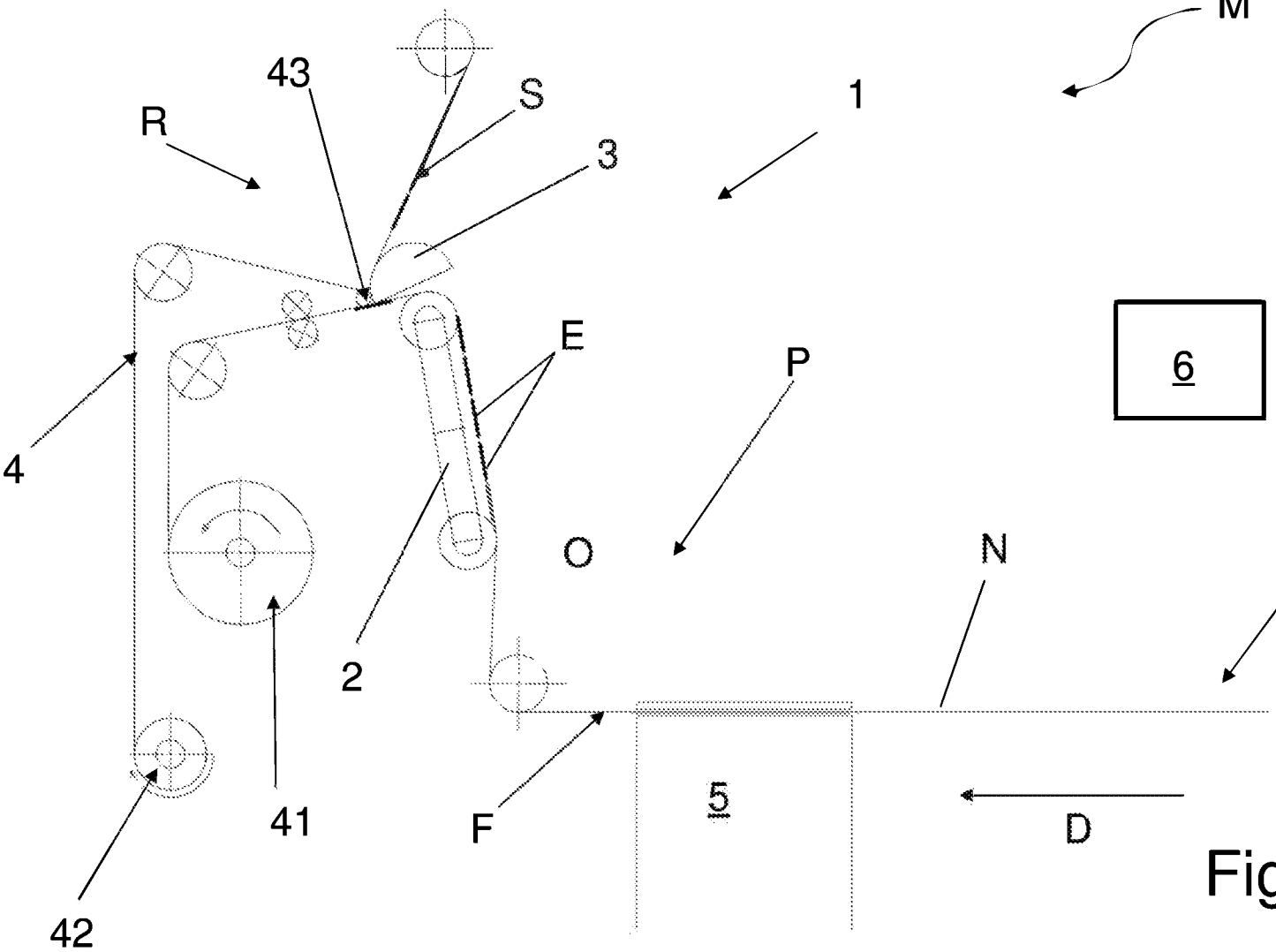
FIG. 2 schematically illustrates a label-rejecting station according to the invention, in a second operating configuration.

With reference to the attached FIGS. 1 and 2, numeral 1 indicates a label-rejecting station according to the present invention.

As previously specified, the labels E are of the self-adhesive type and may be applied to any type of article, for example, containers in the pharmaceutical sector. The labels E may include some printing containing information of different types (identification code/barcode of the article, content and/or relative expiry date, logo/image, etc.).

The labels E are carried by a support band N along an advancing path P (indicated generically in FIGS. 1 and 2). With reference to the attached figures, the labels E are shown schematically only along part of the support band N.

The advancing path P develops from a feeding zone Z wherein the labels E to be applied to the articles are fed, supported by the support band N, to a label-application zone (not illustrated) where the labels E are applied to the respective articles (also not illustrated). The rejecting station 1 is arranged between the feeding zone Z and the label-application area.

The support band N moves along a feed direction D and comprises two surfaces opposite each other, first F and second S, with the labels E being applied to the first surface F of the support band N.

The label-rejecting station according to the invention comprises a deviator element 2, arranged along the advancing path P and movable between an inactive position I (FIG. 1) and an active position O (FIGS. 2 and 3), wherein it contacts the support band N at its first surface F, deviating its advancing path P.

In particular, the rejecting station 1 comprises a contrast element 3, arranged along the advancing path P, downstream of the deviator element 2. The contrast element 3, in turn, comprises: an abutting surface 30, designed to partially receive thereon the second surface S of the support band N (opposite to the first surface F) advancing of the support band N; and a detachment edge 31 (indicated in FIG. 3), designed to detach a label E from the support band N (in particular, from the first surface F of the support band N) when the deviator element 2 moves into the relative active position O (see FIGS. 2 and 3).

Advantageously, the label-rejecting station 1 proposed with the invention considerably reduces the loss of tension of the support band N in the case of rejection of a label E compared to known solutions, i.e., in the case of deviation of the advancing path P. This is due to the fact that the deviator element 2 and the contrast element 3, contrary to the known art, are made up of two distinct elements that cooperate to allow the detachment of a label E to be discarded when needed. In particular, the deviator element 2 and the contrast element 3 operate at two opposite surfaces F, S of the support band N. This aspect, advantageously, translates into the fact that a minimum deviation of the support band N is required (by means of the deviator element 2) until detachment of a label E to be discarded (i.e., its lifting) from the supporting band N itself occurs, as will be made clearer below. From this it follows the fact that, even in the case of rejection of a label E, the tension of the support band N remains substantially unchanged compared to the case wherein it is not necessary to discard a label E, thus ensuring the correct application of the labels E to the relative articles.

According to the preferred embodiment, the contrast element 3 is arranged in a fixed manner along the advancing path P. In other words, the contrast element 3 is neither movable with respect to the support band N, nor with respect to the deviator element 2 (both when the latter is in the relative inactive position I, and when the latter is in the relative active position O). This aspect guarantees a particular structural and functional simplicity, as it is the only deviator element 2 that is movable, although the contrast element 3 also contributes to the detachment of a label E from the support band N.

As already said, the abutting surface 30 of the contrast element 3 partially receives the support band N resting in a portion of the advancing path P downstream of the deviator element 2, in particular, both when the latter is in the relative inactive position I, and when the latter is in the relative active position O.

According to the preferred embodiment illustrated, the abutting surface 30 of the contrast element 3 has an arch-shaped development (i.e., it defines a curved profile). This aspect avoids the unwanted detachment of labels E when the deviator element 2 is in its inactive position I.

According to the preferred embodiment illustrated, the detachment edge 31 of the contrast element 3 comprises a corner 31 formed between two adjacent sides 32, 33 of the contrast element 3, with the two sides 32, 33 of the contrast element 3 that form an acute U angle between them. The detachment edge 31, preferably, consists of this corner 31 of the contrast element 3. Preferably, one of the two sides 32, 33 of the contrast element 3 comprises the aforementioned abutting surface 30 (see FIG. 3).

According to a preferred embodiment, the contrast element 3 has a hemispherical or semi-elliptical cross-section.

Figure 3:
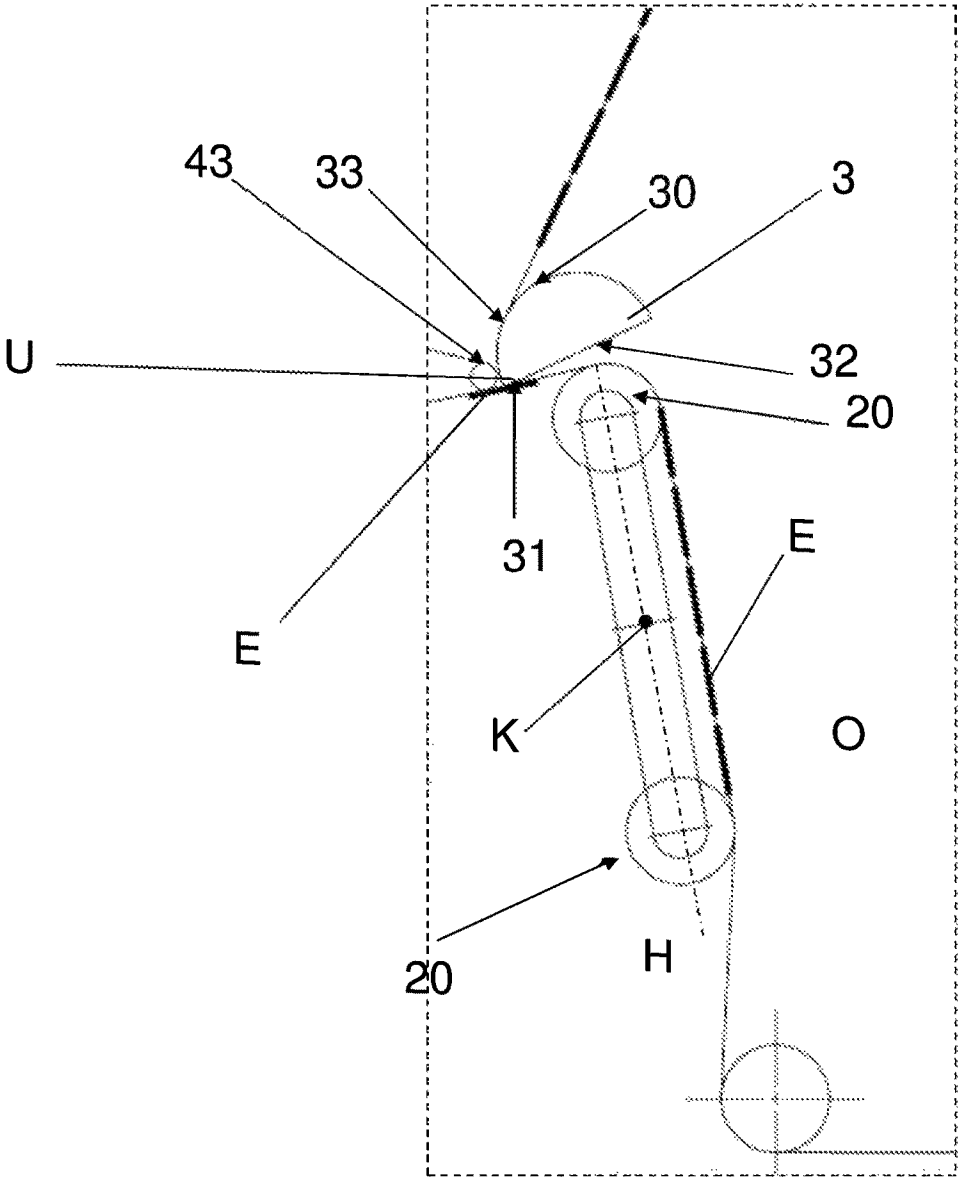
FIG. 3 is an enlarged view of a part of FIG. 2.

According to the preferred embodiment illustrated, the deviator element 2 has a prevailing longitudinal axis of development H and is movable by swinging between the inactive position I and the active position O around a swinging axis K passing through its axis of development (see FIG. 3). Preferably, the deviator element 2 is rod-shaped.

Preferably, the swinging axis K of the deviator element 2 is perpendicular to the longitudinal axis of development H of the deviator element 2. More specifically, the swinging axis K is preferably perpendicular to the lying plane (not indicated in the figures) of the deviator element 2.

According to the preferred embodiment illustrated, the longitudinal development axis H of the deviator element 2 is arranged partially parallel to the advancing path P (i.e., it is parallel to a section of this advancing path P). Even more preferably, again with reference to the attached figures, the deviator element 2 partially supports the support band N when it is arranged in the relative inactive position I and when it is arranged in the relative active position O. Advantageously, this aspect further reduces the deviation necessary to detach a label E from the support band N, i.e., the swinging angle of the deviator element 2 around its swinging axis K.

With reference to the attached figures, the deviator element 2 carries at least one roller 20 at one of its ends, to facilitate the sliding of the support band N thereon. With reference to the attached figures, the deviator element 2 carries two rollers 20, one at each of its opposite ends.

Preferably, the swinging angle of the deviator element 2 (between the inactive position I and the active position O) is between 25° and 45°. This angle is particularly reduced, thus allowing a lower loss of tension of the support band N compared to the known art. Even more preferably, this angle is comprised between 30° and 40°. This range of values allows an even lower loss of tension than known solutions. With reference to the attached figures, the deviation angle is 33°. This value is an optimal compromise between the need to deviate the advancing path P of the support band N to obtain the correct detachment of a label E from the support band N itself, and the need to minimize the tension of the support band N following such a deviation.

The rejecting station 1 preferably also comprises a collecting band 4 of the rejected labels E, which extends along a collection path R (indicated in a generic way in FIGS. 1 and 2) of the labels E, arranged adjacent to the advancing path P of the support band N at least at the contrast element 3. The collecting band 4 is designed to receive a label E detached from the support band N following the movement of the deviator element 2 into its active position O.

According to the preferred embodiment illustrated, the collecting band 4 is wrapped at least partially around a collection roller 41, which can be activated in rotation around its own axis to move the collecting band 4 when the deviator element 2 moves into the relative active position O. Preferably, the collection roller 41 can be activated in rotation to move the collecting band 4 at the same advancing speed as the support band N when the deviator element 2 moves into the relative active position O, so as to allow the optimal passage of the label E from the support band N to the collecting band 4 (i.e. the detachment of the label E to be discarded from the support band N and its "automatic" adhesion to the collecting band 4). On the opposite side of the collecting roller there is an unwinding roller 42 that rotates in a rotation direction opposite to that of the collecting roller 41 to unwind the collecting band 4 as it is wound onto the collecting roller 41 (see FIGS. 1 and 2). Between the unwinding roller 42 and the collecting roller 41 there are a series of return rollers 43 that determine the collecting path R.

Preferably, the return rollers 43 keep the collecting band 4 adjacent to the support band N, both when the deviator element is in the relative inactive position I, and when the deviator element 2 is in the relative active position O. This aspect guarantees an easy passage of a label E to be discarded from the support band N to the collecting band 4.

According to the preferred embodiment, the collecting band 4 is tangent to the support band N at least at the abutting surface 30 of the contrast element 3, near or at the detachment edge 31. This aspect guarantees even more the correct adhesion of a rejected label E to the collecting band 4.

According to the preferred embodiment, the rejecting station 1 according to the invention also comprises a sensor 5 arranged along the advancing path P of the support band N upstream of the deviator element 2 (and of the contrast element 3), arranged to detect the possible non-conformity of a label E on the support band N, and to send a corresponding signal. The sensor 5 is preferably arranged to face the first surface F of the support band N.

The rejecting station 1 further comprises a control unit 6 (schematically illustrated in FIGS. 1 and 2), arranged to receive the signal from the sensor 5, and consequently to control the deviator element 2 so that it moves to the relative active position O.

An inconsistency of a label E may regard, for example, its printing: which could—in fact—be faded, not very visible, partially or completely missing.

According to the preferred embodiment, the control unit 6 is also provided for commanding the collecting roller 41 to rotate in order to move the collecting band 4 when the signal has been received.

Preferably the sensor 5 is a sensor 5 of the optical type (camera, video camera, photocell or other).

The operation of the label-rejecting station 1 according to the invention will now be briefly described, with reference to the attached figures.

The labels E are fed—carried by the support band N—along the advancing path P at the feeding zone Z, first arriving at the sensor 5 for checking the conformity of the labels E. If the labels E are all compliant, (that is they do not have irregularities or printing errors), they pass through the rejecting station 1, with the deviator element 2 remaining in the relative inactive position I (FIG. 1) and receiving the first surface F of the support band N partially thereon. The support band N, passing through the rejecting station 1, then partially rests (with its second surface S) on the abutting surface 30 of the contrast element 3, with the labels E remaining on the support band N itself (i.e., they do not detach). The support band N with the labels E is conveyed towards the application zone (not illustrated), where the labels E will be applied onto respective articles. The collecting band 4 and the collecting roller 41, in this situation, remain stationary.

If, on the other hand, the sensor 5, during the advancement of the support band N, detects a non-compliant label E, it sends a corresponding signal to the control unit 6. This activates the deviator element 2 so that it moves to the second position when the label E to be discarded is at the detachment edge 31 of the contrast element 3. Also in this situation, the deviator element 2 receives a portion of the support band N resting thereon. At the same time, the control unit 6 also activates the collecting roller 41 to move the collecting band 4 at the same speed as the support band N, to receive and remove the label E detached from the support band N.

The invention also relates to a labelling machine M (partially visible in FIGS. 1 and 2) comprising: a feeding zone Z of labels E, where the labels E are fed supported by the support band N, and a zone (not illustrated) for applying the labels E to corresponding articles. The labelling machine M also comprises a rejecting station 1 for labels E in accordance with any of the previous embodiments described, interposed between the feeding zone Z and the label-application zone.

The labelling machine M is preferably a labelling machine M of the pharmaceutical sector.

The invention claimed is:

1. A label-rejecting station, with labels being carried by a support band along an advancing path, the rejecting station comprises:

a deviator element, arranged along the advancing path, and movable between an inactive position and an active position wherein it contacts the support band at a first surface thereof, deviating the advancing path; and a contrast element, separate and distinct from the deviator element and arranged along the advancing path downstream of the deviator element, comprising in turn:

an abutting surface configured to receive partially thereon a second surface of the support band, opposite to the first surface, during its advancement; and a detachment edge configured to detach a label from the support band when the deviator element moves into its active position;

wherein the labels are carried by the support band on the first surface of the support band.

2. The rejecting station of claim 1, wherein the contrast element is unmovable along the advancing path.

3. The rejecting station of claim 1, wherein the abutting surface of the contrast element has an arch-shaped development.

4. The rejecting station of claim 1, wherein the detachment edge of the contrast element comprises a corner provided between two sides of the contrast element, the two sides of the contrast element defining an acute angle between them.

5. The rejecting station of claim 1, wherein the deviator element has a prevailing longitudinal development axis and is configured to swing between the inactive position and the active position around a swinging axis passing through its longitudinal development axis.

6. The rejecting station of claim 5, wherein the longitudinal development axis of the deviator element is at least partially parallel to the advancing path.

7. The rejecting station of claim 6, wherein the deviator element partially receives the support band when the deviator element is in its inactive position and when it is in its active position.

8. The rejecting station of claim 5, wherein a swinging angle of the deviator element is between 25° and 45°.

9. The rejecting station of claim 1, further comprising a collecting band for rejected labels developing along a collecting path of the labels, adjacent to the advancing path of the support band at least at the contrast element; the collecting band being provided for receiving a label detached from the support band following movement of the deviator element into its active position.

10. The rejecting station of claim 9, wherein the collecting band is at least partially wound around a collecting roller, which can be activated to rotate in order to move the collecting band with a speed that is a same as a speed of the support band when the deviator element moves into its active position.

11. The rejecting station of claim 10, comprising:

at least one sensor arranged along the advancing path upstream of the deviator element, provided for detecting an inconformity of the label on the support band, and for sending a corresponding signal; and a control unit, provided for receiving the corresponding signal from the at least one sensor and to command the deviator element to move into its active position.

12. The rejecting station of claim 11, wherein the control unit is also provided for commanding the collecting roller to rotate in order to move the collecting band when the corresponding signal has been received.

13. The rejecting station of claim 11, wherein the at least one sensor is an optical sensor.

14. A labelling machine comprising:

a label-feeding zone, where labels are carried by a support band;

an application zone of the labels to corresponding articles; and a label-rejecting station according to claim 1, arranged between the label-feeding zone and the application zone.

* * * * *